US007658087B1

(12) United States Patent
McMurray et al.

(10) Patent No.: US 7,658,087 B1
(45) Date of Patent: Feb. 9, 2010

(54) LIGHT WEIGHT FINE GAUGE DOUBLE FACED TEXTILE ARTICLE

(75) Inventors: Brian L. McMurray, Aberdeen, NC (US); Robert T. Spillane, Lincolnton, NC (US)

(73) Assignee: McMurray Fabrics, Inc., Aberdeen, NC (US)

( * ) Notice: Subject to any disclaimer, the term of this patent is extended or adjusted under 35 U.S.C. 154(b) by 738 days.

(21) Appl. No.: 11/319,800

(22) Filed: Dec. 28, 2005

(51) Int. Cl.
*D04B 9/08* (2006.01)

(52) U.S. Cl. ..... 66/196; 66/8

(58) Field of Classification Search ..... 66/196, 66/193, 195, 202, 8
See application file for complete search history.

(56) References Cited

U.S. PATENT DOCUMENTS 2,067,739 A * 1/1937 Tanski ..... 66/196
4,941,331 A * 7/1990 Cournoyer et al. ..... 66/25
5,422,153 A * 6/1995 Miyamoto ..... 66/196
5,463,881 A * 11/1995 Igarashi et al. ..... 66/31
5,546,769 A * 8/1996 Igarashi et al. ..... 66/20
5,735,145 A * 4/1998 Pernick ..... 66/196
6,526,783 B2 3/2003 Sheu ..... 66/22
6,634,190 B2 * 10/2003 Didier-Laurent ..... 66/196
6,779,369 B2 * 8/2004 Shepherd ..... 66/196

* cited by examiner

*Primary Examiner*—Danny Worrell
(74) *Attorney, Agent, or Firm*—MacCord Mason PLLC

(57) ABSTRACT

A double face, weft-knit textile article is shown and described. The article comprises a first fabric face and a second fabric face integrally constructed with a heat-set elastic yarn. The fabric has a fabric weight of less than about 5 oz. per square yard and is constructed to substantially reduce grin-through or transparency. In addition, the article may be a garment and may further include at least one body anchor for facilitating attachment of the garment to the wearer.

50 Claims, 4 Drawing Sheets

LIGHT WEIGHT FINE GAUGE DOUBLE FACED TEXTILE ARTICLE

BACKGROUND OF THE INVENTION (1) Field of the Invention

The present invention relates generally to weft-knit textile articles and, particularly, to lightweight fine-gauge double faced, weft-knit textile garments. More particularly, the present invention relates to lightweight fine-gauge double-faced weft-knit textile garments, wherein the fabric density of the fabric forming the garments is sufficient to substantially prevent color grin-through or transparency.

(2) Description of Related Technology

Weft-knit fabrics are commonly used for a wide variety of purposes ranging from non-apparel to apparel. Such fabrics are generally desirable because they are durable and easy to manufacture. They are also desirable because they can be manipulated through various knitting techniques. In terms of apparel for example, they are often designed with increased wicking properties or increased breathability, or for increased comfort.

To achieve such objectives, weft-knit fabrics for apparel usually have two distinct sides, an inner side and an outer side. The side of the fabric for wearing against the body, or the inner side, may have a certain knit or may be knitted from a certain thread to alter the properties of the fabric. Athletic apparel, by way of example, may be knitted to maximize comfort, breathability, or wicking properties of the inner side of the fabric. Typically, because of knitting, cost, or function, the side opposite the inner side of the fabric, or the outer side, is not the same as the inner side.

Weft-knit fabrics are also knitted at various weights for various applications. For example, a heavier weight fabric might be ideal for constructing mid or outer layer cold weather athletic apparel, e.g. snow skiing apparel, while a lighter weight fabric may be ideal for constructing warm weather apparel, e.g. warm weather jogging apparel. Lightweight fabrics may also be ideal for constructing cold weather apparel, such as base layer apparel, to be worn close to the body under other layers. Lightweight fabric apparel is ideal in such various situations because of its ability to wick perspiration, breath, move with the body, and reduce chaffing. Additionally, lightweight fabric apparel is desirable as a base layer to be worn during cold weather activities because of its ability to reduce friction between other layers of clothing. Some have tried to produce lighter weight fabrics in an attempt to increase the beneficial properties of lightweight fabric discussed above, yet these previous attempts have generally been unsuccessful.

Such attempts typically produce fabrics with reduced durability and wearability. More specifically, such fabrics have an increased tendency to unravel, run or ladder, which is undesirable because it can increase chafing and friction. Additionally, such attempts at producing lighter weight fabrics for construction of lightweight garments, such as lightweight silk garments, have been unsuccessful in that these garments do not conform to the body or move with the body, but rather hang off the body. When these traditional garments are worn in warm weather activities such fabric-hang or, inability to conform to the body, creates dead air space that both prevents heat from escaping and prevents moisture from being wicked off the body. Such fabric-hang can further create flaps of fabric that increase chafing. The above-mentioned results are undesirable. Further, when these traditional garments are worn as base layers during cold weather activities such fabric-hang also chafes the wearer as it bunches under other layers.

Fabric-hang also restricts movement as it increases friction between the base layer and other garment layers. These results are, as well, undesirable.

Some have tried to improve fabric construction by increasing the ability of lightweight fabrics to conform to the body, thereby decreasing fabric-hang. For example, some have incorporated elastic thread into the cuffs or waistbands of garments in an attempt to maintain the lightweight construction of the garment fabric and increase the fabrics ability to conform to the body. Such techniques produce only margin results because, while the garment is constructed of a lighter weight fabric, there is still signification fabric-hang and the fabric is still prone to laddering and unraveling. Others have incorporated elastic thread into lightweight fabrics to construct garments that conform to the body. While these attempts decrease fabric hang, they significantly increase fabric weight, thereby reducing some of the beneficial properties associated with using lightweight fabrics to construct garments.

Additionally, such fabrics are prone to grin-through or transparency, which can be undesirable. For example, grin-through or transparency can be undesirable if a garment is supposed to have a specific color or print because the outer face of the garment would not remain true to the desired color or print. Similarly, grin-through or transparency can be undesirable for reversible garments because each face of the garment would not remain true to the desired print or color. Additionally, grin-through or transparency can be undesirable in warm weather sport-tops, such as jog bras for women, or sport-bottoms, such as shorts for men or women, because such lightweight fabrics may be too revealing, particularly, when they become wet with perspiration.

Thus what is needed is a durable garment constructed of a lightweight fabric with a high resistance to laddering or unraveling. The fabric should further include an ability to conform to the body and should also possess the ability to substantially prevent grin-through or transparency.

SUMMARY OF THE INVENTION

The present invention is directed to a double face, weft-knit textile article. In one embodiment, the article is a garment comprising a first fabric face and a second fabric face. In this embodiment, the first face and the second face are integrally constructed with a heat-set elastic yarn, and have a fabric weight of less than about 5 oz. per square yard. In some embodiments, the fabric has a weight between about 2 oz. per square yard and about 5 oz. per square yard, and preferably has a fabric weight of about 2.5 to 4.5 oz. per square yard, and more preferably has a fabric weight of about 3 to 4 oz. per square yard, with the most preferable weight being about 3.6 oz per square yard. Still, those who use the present invention to produce dark fabrics, such as black or dark purple fabrics, may prefer a fabric weight of about 4 oz. per square yard. The fabric of the present invention comprises a first yarn for forming the first face; a second yarn for forming the second face; and a third yarn for tucking to the first face and to the second face, wherein the third yarn is substantially elastic.

In addition, the garment may further include a body anchor for facilitating attachment to the wearer. For example, the body anchor may be a head opening, for example, of a poncho. The body anchor may be a torso opening, for example, for a pair of bottoms such as skirts, kilts, shorts and pants. The body anchor may include at least one arm opening, for example, for a shirt such as a long sleeve, short sleeve, jersey, vest, jacket or coat.

In one embodiment of the invention, the fabric is integrally knit on an interlock gated double knit knitting machine. Preferably, the fabric is knit on a fine gauge circular 42 cut interlock weft knitting machine. Also, the fabric is at least partially knitted of synthetic yarn and preferably is substantially 100% synthetic yarn such as polyester or nylon.

Preferably, the first face and the second face of the fabric are both composed of technical needle loops.

The fabric is knitted of at least a first yarn, a second yarn, and a third yarn. Preferably, the first yarn is a polyester multifilament yarn and is substantially flat or substantially textured with a substantially round cross section. The filament count of the first yarn is between about 10 and 30, and preferably is between about 15 and 25, with the most preferred filament count being about 24. Others may prefer to use different filament counts or different multifilament or monofilament yarns, such as nylon, or yarns of a different texture or of a different cross section, such as trilobal for example, all of which would be within the scope of the present invention. Preferably, the first yarn has a luster from between about semi-dull to dull. In addition, the first yarn has a denier between about 20 and 40, with 30 being the preferred denier. While the first yarn may be dyed or un-dyed, depending on the fabric application, Applicants prefer an un-dyed first yarn, which results in a natural silver-like or metal coloring effect. In terms of garment construction, Applicants prefer using the first yarn for forming the inner surface of the fabric, or the surface to be worn closer to the body, in part, because of its wicking characteristics and breathability. Others, however, may wish to use the first yarn for forming the outer surface or for forming either the inner or outer surface in reversible garments.

Preferably, the second yarn is a nylon multifilament yarn and is substantially flat or substantially textured with a substantially round cross section. The filament count of the second yarn is between about 30 and 50, and preferably is about 34. Others may prefer to use different filament counts or different multifilament or monofilament yarns, such as polyester, or yarns of a different texture or of a different cross section, such as trilobal for example, all of which would be within the scope of the present invention. Preferably, the second yarn has a luster from between about bright to full dull, and more preferably from about semi-dull to dull. In addition, the second yarn has a denier between about 30 and 50, with 40 being the preferred denier. While the second yarn may be dyed or un-dyed, depending on the fabric application, Applicants prefer to use a dyed first yarn. In terms of garment construction, Applicants prefer to use the second yarn for forming the outer surface of the fabric, or the surface to be worn away from the body. Others, however, may wish to use the second yarn for forming the inner surface or for forming either the inner or outer surface in reversible garments.

While in some preferred embodiments, the first and second yarns may be of a different denier or have a different filament count or may be made of different material or may have a different luster or cross section, those skilled in the art would recognize from the above summary, that the first and second yarn could also be the same yarn. Such a fabric construction would be within the scope of the present invention.

The third yarn is an elastic yarn, and is preferably spandex because of spandex's desirable frictional properties, yet others may prefer to use other elastic yarns, which would still be within the scope of the present invention. More preferably, the third yarn is fine-denier spandex, and has a denier of between about 20 and 70, and more preferably has a denier of between about 30 and 50, with the most preferable denier being about 40. The third yarn may also be heat-settable such that heat sets a permanent crimp in the yarn, preferably at the tuck stitch, thereby locking the stitch and reducing raveling or laddering down any row of successive stitches, such as the vertical row or wales, for example. Preferably, the yarn is heated to permanently re-denier the yarn so as to further create a barrier resistant to slippage of the first of second yarn and further reduce raveling or laddering. Applicants prefer to heat at temperatures greater than about 350 degrees Fahrenheit and more preferably at temperatures greater than about 385 degrees Fahrenheit, yet others may prefer higher or lower temperatures depending on heat-setting techniques or fabric construction, which would still be within the scope of the present invention. Heat setting according to the present invention can be performed either before or after dying of the fabric or of the various yarns.

Further, because of the construction of the fabric of the present invention, the third yarn is not substantially visible from the first face or from the second face of the fabric. Preferably, the third yarn is hidden by knitting it substantially behind the needle loop stitch of the first face and substantially behind the needle loop stitch of the second face. Additionally, the third yarn may be hidden by its transparent properties.

Further, by constructing the fabric of the present invention using fine denier yarns and high stitch density on both faces of the fabric, color grin-through or fabric transparency is substantially prevented. The fabric construction also produces two low friction faces, either of which may be worn against the body.

Additionally, while the present invention has been described primarily in terms of garments, it also encompasses other articles besides garments, such as any number of bags; hats; or head, wrist, arm, elbow, knee or ankle bands or supports, medical or otherwise, to mention a few for example. Similarly, either face of the article, or both faces of the article, may be yarn dyed or piece dyed with a color.

These and other aspects of the present invention will become apparent to those skilled in the art after a reading of the following description of the preferred embodiment when considered with the drawings.

DESCRIPTION OF THE PREFERRED EMBODIMENTS

Figure 1:
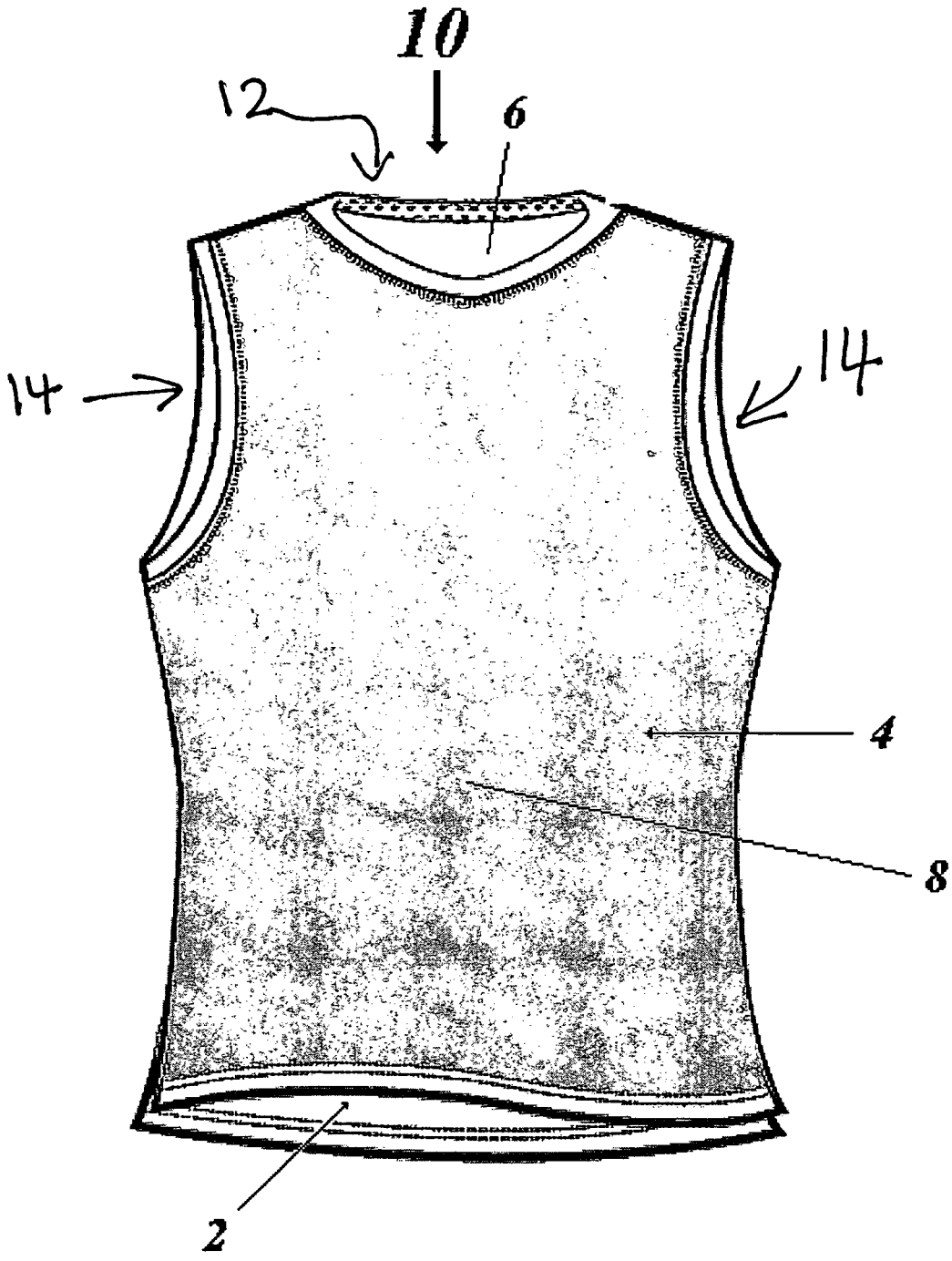
FIG. 1 shows a perspective view of one embodiment of a textile article constructed according to the present invention.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Referring now to the drawings in general and FIG. 1 in particular, it will be understood that the illustrations are for the purpose of describing a preferred embodiment of the invention and are not intended to limit the invention thereto. As best seen in FIG. 1, a weft-knit textile article, generally designated 10, is shown constructed according to the present invention. In this embodiment the textile article is a sleeveless shirt 10. The shirt 10 has a body anchor for helping the shirt 10 stay on the wearer's body. In this case the anchor could be either the head opening 12 or the arm openings 14. The shirt 10 has a first face 2, and a second face 4. The first face 2 has a first color 6 and the second face 4 has a second color 8. The first face 2 is shown as the inner face and the second face 4 is shown as the outer face, yet in some embodiments, the shirt 10 may be reversible such that either face could be either the inner or the outer face.

Figure 2:
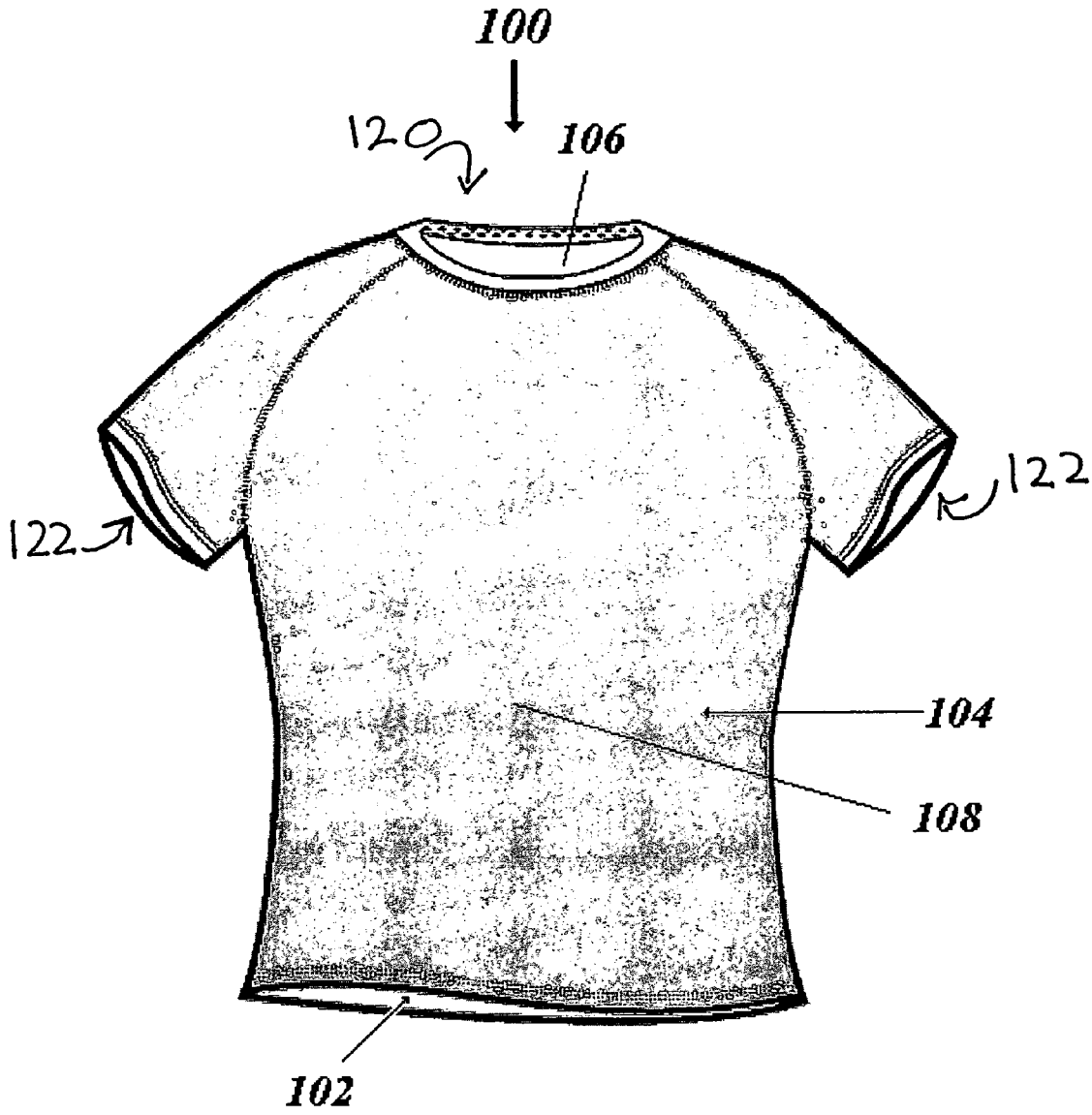
FIG. 2 shows a perspective view of an additional embodiment of the textile article constructed according to the present invention.

FIG. 2 shows an additional embodiment of the textile article of the present invention. In this embodiment, the textile article is a shirt 100. The shirt shown is a short-sleeved shirt, but the description would apply equally to a long sleeved shirt. The shirt 100 has a body anchor, which could be either the head opening 120 or the arm openings 122. The shirt 100 has a first face 102 and a second face 104. The first face 102 has a first color 106 and the second face 104 has a second color 108. The first face 102 is shown as the inner face and the second face 104 is shown as the outer face, yet in some embodiments, the shirt 100 may be reversible such that either face could be either the inner or the outer face.

Figure 3:
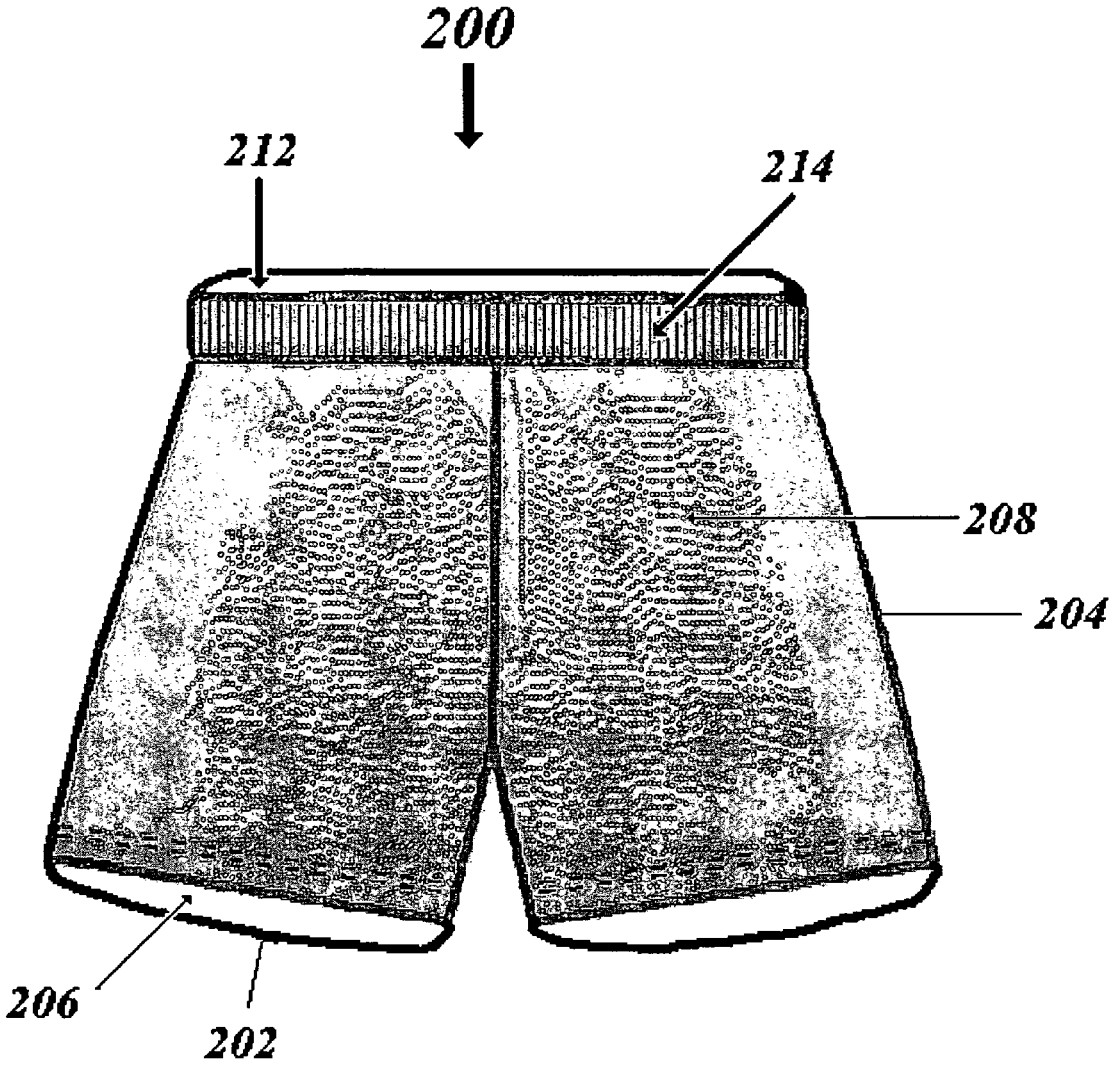
FIG. 3 shows still an additional embodiment of the textile article of the present invention.

FIG. 3 shows an additional embodiment of the textile article of the present invention. In this embodiment, the textile article is a pair of running pants 200, specifically short pants or shorts. The shorts 200 have an anchor 212 for helping them stay on the wearer's body. In this case the anchor is the opening for the torso 212. An elastic waistband 214 or a similar anchor-tightener, such as a belt or draw-string (not shown) may be used to further facilitate anchoring the article to the wearer's body. The shorts 200 have a first face 202 and a second face 204. The first face 202 has a first color 206 and the second face 204 has a second color 208. The first face 202 is shown as the inner face and the second face 204 is shown as the outer face, yet in some embodiments, the shorts 200 may be reversible such that either face could be either the inner or the outer face.

Figure 4:
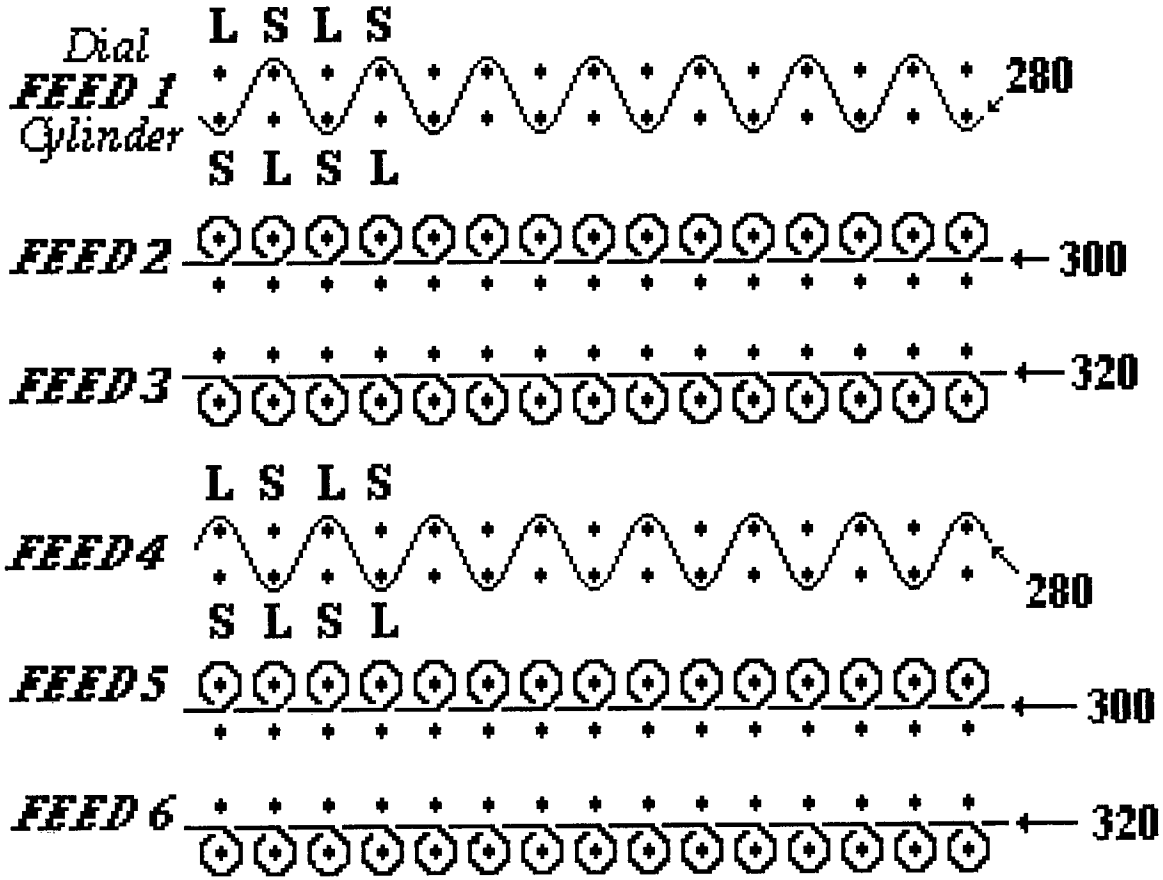
FIG. 4 shows a schematic diagram representing one embodiment of the knitting process of the present invention.

FIG. 4 represents knitting one preferred embodiment of the invention using an interlock double knit machine. The most preferred machine for achieving the present invention is a circular machine having a cylinder needle bed and a dial needle bed, such as a Monarch FIM-108A, available from the Monarch Knitting Machine Corporation of Monroe, N.C., with a 30" diameter having 42 needles/inch and 108 feeds. Those skilled in the art will recognize that a double needle bed weft-knitting machine of a flat bed configuration might also be used to produce the present invention, and fabrics made on such a machine, or other similar machines, are considered to be within the scope of the invention.

FIG. 4 describes a 6 feed knitting sequence repeating on 2 needles, each feed knitting one course, creating a pattern repeat for forming a fabric according to the present invention. The needles of the knitting machine are arranged in an interlock gating, meaning that each of the two needle beds includes a plurality of needles. The needles and their respective needle beds are exactly opposite relative to each other. The needle arrangement in both the dial and cylinder needle beds alternate between long and short needles consecutively about the circumference of the knitting machine, and are gated into the interlock relationship with the long needles of the dial directly opposing the short needles of the cylinder, and short needles of the dial directly opposing the long needles of the cylinder. Cylinder needles move vertically up and down in the cylinder bed, while Dial needles move in a horizontal manner in the dial bed.

Feed 1 forms the first course of the 6 feed knitting sequence using third yarn 280 as it is fed alternately to the knitting elements between the dial and cylinder needle beds to tuck only on all short needles of the cylinder bed, while also tucking only on all short needles of the dial bed. In this embodiment, the third yarn 280 is substantially transparent and a relatively fine denier, synthetic, continuous monofilament spandex elastomeric yarn, in a denier range of between about 30 and 55 denier. The most preferred embodiment uses a 40 denier clear or bright luster essentially in a round cross-section.

Feed 2 forms the second course of the 6 feed knitting sequence using first yarn 300 as it is fed to the knitting elements essentially knitting on all long and short needles of the dial bed while missing all long and short needles of the cylinder bed. In this embodiment, the first yarn 300 is preferably substantially opaque with a luster between bright and full dull, and is a fine denier textured or flat, preferably flat, synthetic continuous multifilament polyester yarn in a range between 20 and 40 denier. More preferably the first yarn 300 is a 30 denier semi-dull round cross-section and has a filament count in a range between 10 and 30, preferably about 20, and most preferably about 24 filaments.

Feed 3 forms the third course of the 6 feed knitting sequence using second yarn 320 as it is fed to the knitting elements essentially knitting on all long and short needles of the cylinder bed while missing all long and short needles of the dial bed. In this embodiment, the second yarn 320 is preferably substantially opaque with a luster between bright and full dull, and is a fine denier textured or flat synthetic continuous multifilament polyester yarn in a range between 20 and 40 denier. Preferably, the second yarn is a flat or textured synthetic continuous filament yarn and preferably is a multifilament nylon or polyester yarn, more preferably nylon. In addition, the second yarn 320 may have a luster between about substantially bright to full dull, preferably semi-dull or dull. Preferably, the second yarn 320 has a round cross-section, yet others may prefer to use yarns with other cross sections, such as, for example, trilobal cross sections. Preferably, the denier of the second yarn 320 is between about 30 and 50, and more preferably about 40, and has a filament count in a range between 30 and 50, preferably about 34 filaments.

Feed 4 forms the fourth course in the 6 feed knitting sequence using third yarn 280 as it is fed alternately to the knitting elements between the dial and cylinder needle beds to tuck only on all long needles of the cylinder bed, while also tucking only on all long needles of the dial bed. Feed 4 is similar to Feed 1, except it engages all long needles that Feed 1 missed when tucking only to short needles of the dial and cylinder.

Feed 5 is identical to Feed 2 and forms the fifth course of the 6 feed knitting sequence using first yarn 300 as it is fed to the knitting elements essentially knitting on all long and short needles of the dial bed while missing all long and short needles of the cylinder bed.

Feed 6 is identical to Feed 3 and forms the sixth course of the 6 feed knitting sequence using second yarn 320 as it is fed to the knitting elements essentially knitting on all long and short needles of the cylinder bed while missing all long and short needles of the dial bed. Feed 6 ends the 6 feed repeat of the knitting sequence and the described 6 feed knitting sequence would be essentially repeated sequentially about the circumference of the knitting machine, for example repeating 14 times on a knitting machine equipped with 84 feed positions, or repeating 18 times on a knitting machine equipped with 108 feed positions about the machine circumference.

Those skilled in the art will be able to use the above described knitting sequence to produce fabric that has a stitch density of between about 3000 and 6000 stitches per square inch; between about 3500 and 6000 stitches per square inch; between about 4000 and 5500 stitches per square inch; and even more preferably has a stitch density of about 5000 stitches per square inch. The fabric will further have a weight between about 2.0 and 5.0 oz. per square yard, preferably between about 2.5 and 4.5 oz. per square yard, and more preferably between about 3.0 and 4.0 oz. per square yard, with the most preferable weight being about 3.6 oz. per square yard.

Certain modifications and improvements will occur to those skilled in the art upon a reading of the foregoing description. By way of example, those skilled in the art may desire to increase the number or density of stitches to further increase fabric opacity. Such modifications may increase fabric weight. Such modifications may also allow for the use of even lower denier yarns in order to minimize the fabric weight. Further, coarser fabric structures of lower stitch density could be used to minimize fabric weight. Also, fine denier yarns could be used in a tighter fabric structure with other fine gauges, such as 32 or 36 gauges, and finishing the fabric with a substantially high number of wales per inch Such modifications may allow for fabric density sufficient to achieve an outer fabric face without color grin-through or transparency. It should be understood that all such modifications and improvements have been deleted herein for the sake of conciseness and readability but are properly within the scope of the following claims.

We claim:

1. A double face, weft-knit fabric having a fabric weight of less than about 5 oz. per square yard, the fabric comprising:

(a) a first face formed by a plurality of first yarns, wherein the first face includes at least one course having at least three consecutively knitted loops formed by at least three consecutive needles A, B, and C;

(b) a second face formed by a plurality of second yarns, wherein the second face includes at least one course having three consecutively knitted loops formed by at least three consecutive needles X, Y, and Z positioned opposite of needles A, B, and C in interlock gating, thereby positioning the at least three knitted loops of the second face exactly opposite the at least three knitted loops of the first face, and (c) a plurality of substantially elastic third yarns, wherein in the at least one course, at least one of the plurality of third yarns tucks behind the loop formed by needle A, then tucks behind the loop formed by needle Y, and then tucks behind the loop formed by needle C, and wherein the at least one of the plurality of third yarns includes a structural crimp behind the loop formed by needle A, behind the loop formed by needle Y, and behind the loop formed by needle C, wherein the structural crimp is created by heat.

2. The fabric of claim 1, wherein the fabric is integrally knit.

3. The fabric of claim 2, wherein the fabric is integrally knit on an interlock gated double knit knitting machine.

4. The fabric of claim 3, wherein the fabric is knit on a fine gauge circular 42 cut interlock weft knitting machine.

5. The fabric of claim 1, wherein the fabric is at least partially synthetic.

6. The fabric of claim 1, wherein the fabric is substantially 100% synthetic.

7. The fabric of claim 1, wherein the first face and the second face are substantially identical.

8. The fabric of claim 7, wherein the first face and the second face are both comprised of technical needle loops.

9. The fabric of claim 1, wherein the fabric has a stitch density of between about 3000 and 6000 stitches per square inch.

10. The fabric of claim 9, wherein the fabric has a stitch density of about 5000 stitches per square inch.

11. The fabric of claim 1, wherein the fabric has a fabric weight of between about 2 and 5 oz. per square yard.

12. The fabric of claim 11, wherein the fabric has a fabric weight of between about 2.5 and 4.5 oz. per square yard.

13. The fabric of claim 12, wherein the fabric has a fabric weight of between about 3 and 4 oz. per square yard.

14. The fabric of claim 1, wherein the plurality of first yarns include is a multifilament yarn.

15. The fabric of claim 1, wherein the plurality of first yarns include a substantially flat yarn.

16. The fabric of claim 1, wherein the plurality of first yarns include a substantially textured yarn.

17. The fabric of claim 1, wherein the plurality of first yarns include a yarn having has a substantially round cross section.

18. The fabric of claim 1, wherein at least one of the plurality of first yarns has a luster from between about semi-dull to dull.

19. The fabric of claim 1, wherein the plurality of first yarns are polyester.

20. The fabric of claim 1, wherein the plurality of first yarns have a denier of between about 20 and 40.

21. The fabric of claim 20, wherein the plurality of first yarns have a denier of about 30.

22. The fabric of claim 14, wherein the plurality of first yarns has a filament count of between about 10 and 30.

23. The fabric of claim 22, wherein the plurality of first yarns have a filament count of between about 15 and 25.

24. The fabric of claim 23, wherein the plurality of first yarns have a filament count of 24.

25. The fabric of claim 1, wherein at least one of the plurality of first yarns is dyed.

26. The fabric of claim 1, wherein the plurality of first yarns are for forming an inner face.

27. The fabric of claim 1, wherein the plurality of second yarns include a multifilament yarn.

28. The fabric of claim 1, wherein at least one of the second yarns is substantially flat.

29. The fabric of claim 1, wherein at least one of the second yarns is substantially textured.

30. The fabric of claim 1, wherein at least one of the second yarns has a substantially round cross section.

31. The fabric of claim 1, wherein at least one of the second yarns has a luster from between about bright to full dull.

32. The fabric of claim 31, wherein the at least one second yarn has a luster from between about semi-dull to dull.

33. The fabric of claim 27, wherein the plurality of second yarns have a denier of between about 30 and 50.

34. The fabric of claim 33, wherein at least one of the second yarns has a denier of about 40.

35. The fabric of claim 27, wherein the plurality of second yarns have a filament count of between about 30 and 50.

36. The fabric of claim 35, wherein at least one of the second yarns has a filament count of about 34.

37. The fabric of claim 27, wherein at least one of the second yarns is dyed.

38. The fabric of claim 27, wherein the plurality of second yarns are for forming an outer face.

39. The fabric of claim 27, wherein the second yarn is chosen selected from a group of yarns including nylon and polyester.

40. The fabric of claim 1, wherein the plurality of third yarns are spandex.

41. The fabric of claim 40, wherein at least one of the third yarns is fine-denier spandex.

42. The fabric of claim 41, wherein the at least one third yarn has a denier of between about 20 and 70.

43. The fabric of claim 42, wherein the at least one third yarn has a denier of between about 30 and 50.

44. The fabric of claim 43, wherein the at least one third yarn has a denier of about 40.

45. The fabric of claim 1, wherein the plurality of third yarns are heat-settable.

46. The fabric of claim 45, wherein the plurality of third yarns are heat-settable at greater than about 350 degrees Fahrenheit.

47. The fabric of claim 1, wherein the fabric is heat-set at about 385 degrees Fahrenheit, thereby re-deniering and forming a permanent crimp in the plurality of third yarns.

48. The fabric of claim 1, wherein the plurality of third yarns are not substantially visible from the first face or from the second face of the fabric.

49. The fabric of claim 8, wherein the plurality of third yarns are located substantially behind the needle loop stitch of the first face and substantially behind the needle loop stitch of the second face.

50. The fabric of claim 1, wherein another of the plurality of third yarns tucks behind the loop formed by needle X, then tucks behind the loop formed by needle B, and then tucks behind the loop formed by needle Z.

* * * * *

UNITED STATES PATENT AND TRADEMARK OFFICE

CERTIFICATE OF CORRECTION

PATENT NO. : 7,658,087 B1
APPLICATION NO. : 11/319800
DATED : February 9, 2010
INVENTOR(S) : Brian L. McMurray and Robert T. Spillane It is certified that error appears in the above-identified patent and that said Letters Patent is hereby corrected as shown below:

In Column 8, Line 15, after the word include, omit the word "is"

Signed and Sealed this

Twenty-third Day of March, 2010

David J. Kappos

David J. Kappos
*Director of the United States Patent and Trademark Office*